US011351444B2

(12) United States Patent
Pickett

(10) Patent No.: US 11,351,444 B2
(45) Date of Patent: Jun. 7, 2022

(54) METHOD AND APPARATUS FOR PLAYING A CHESS-LIKE GAME

(71) Applicant: Barrett Pickett, McComb, MS (US)

(72) Inventor: Barrett Pickett, McComb, MS (US)

( * ) Notice: Subject to any disclaimer, the term of this patent is extended or adjusted under 35 U.S.C. 154(b) by 0 days.

(21) Appl. No.: 15/886,205

(22) Filed: Feb. 1, 2018

(65) Prior Publication Data

US 2018/0221757 A1 Aug. 9, 2018

Related U.S. Application Data

(60) Provisional application No. 62/456,503, filed on Feb. 8, 2017.

(51) Int. Cl.

| | |
|---|---|
| ***A63F 3/02*** | (2006.01) |
| ***A63F 3/00*** | (2006.01) |
| *A63F 9/24* | (2006.01) |
| *A63F 11/00* | (2006.01) |

(52) U.S. Cl.

CPC ..... *A63F 3/02* (2013.01); *A63F 3/00643* (2013.01); *A63F 3/00697* (2013.01); *A63F 2003/00659* (2013.01); *A63F 2003/00757* (2013.01); *A63F 2003/00772* (2013.01); *A63F 2003/00779* (2013.01); *A63F 2003/00794* (2013.01); *A63F 2003/00804* (2013.01); *A63F 2003/00813* (2013.01); *A63F 2003/00839* (2013.01); *A63F 2009/2402* (2013.01); *A63F 2011/0058* (2013.01)

(58) Field of Classification Search

CPC ..... A63F 3/02; A63F 3/00643–2003/0069

See application file for complete search history.

(56) References Cited

U.S. PATENT DOCUMENTS

| | | | | |
|---|---|---|---|---|
| 3,888,491 A * | 6/1975 | Bernard | A63F 3/00643 | 273/237 |
| 4,082,285 A * | 4/1978 | Bathurst | A63F 3/00643 | 340/323 R |
| 4,193,600 A * | 3/1980 | Armstrong | A63F 1/06 | 273/148 R |
| 4,339,135 A * | 7/1982 | Breslow | A63F 3/00643 | 273/460 |
| 4,391,447 A * | 7/1983 | Dudley | G09B 19/22 | 273/238 |
| 4,398,720 A * | 8/1983 | Jones | A63F 3/00643 | 273/238 |

(Continued)

*Primary Examiner* — Laura Davison

(74) *Attorney, Agent, or Firm* — Dale Jensen, PLC; Dale Jenen

(57) ABSTRACT

A game apparatus includes a housing defining an interior area for electronic components, a top wall of which includes a game board having squares for receiving respective game pieces. A plurality of input buttons are included on each end of the housing by which a player may enter points to be awarded to corresponding moves of game pieces, the point being incremented on respective digital displays. The game board includes a negative containment grid for receiving one or more auxiliary game pieces. Points may be scored as game pieces are moved and opposing game pieces are captured, the game pieces having predetermined high and low values. In addition, the method of use includes a dual point assignment scheme capable of varying the points assigned to the playing pieces.

7 Claims, 10 Drawing Sheets

(56) References Cited

U.S. PATENT DOCUMENTS

| | | | | | |
|---|---|---|---|---|---|
| 4,492,581 | A * | 1/1985 | Arai | G09B 19/22 | 273/238 |
| 4,541,633 | A * | 9/1985 | Newbill | A63F 3/00643 | 273/238 |
| 4,569,526 | A * | 2/1986 | Hamilton | A63F 3/00176 | 273/237 |
| 4,613,134 | A * | 9/1986 | Tobin | A63F 3/02 | 273/242 |
| 5,126,717 | A * | 6/1992 | Renaud | A63F 1/18 | 273/237 |
| 5,200,890 | A * | 4/1993 | Pionchon | G09B 19/22 | 273/148 R |
| 5,934,674 | A * | 8/1999 | Bukowsky | A63F 3/00643 | 273/237 |
| 6,102,397 | A * | 8/2000 | Lee | A63F 3/00643 | 273/238 |
| 6,446,966 | B1 * | 9/2002 | Crozier | A63F 3/00176 | 273/236 |
| 6,835,131 | B1 * | 12/2004 | White | A63F 3/00643 | 273/237 |
| 2009/0017889 | A1 * | 1/2009 | Zhukov | A63F 3/02 | 463/14 |
| 2014/0187319 | A1 * | 7/2014 | Liu | A63F 3/0052 | 463/31 |

* cited by examiner

METHOD AND APPARATUS FOR PLAYING A CHESS-LIKE GAME

REFERENCE TO RELATED APPLICATIONS

This application claims the priority and benefit of provisional patent application U.S. Ser. No. 62/456,503 filed Feb. 8, 2017 titled Spectrum Chess and which is incorporated herein by reference.

BACKGROUND OF THE INVENTION

This invention relates generally to a game apparatus and, more particularly, to a game apparatus and method that utilizes playing pieces having various colors and shapes and a dual point assignment scheme which assigns a high or low point value to playing pieces.

A conventional game of chess is a strategy game enjoyed by millions of people and that involves two opponents each having sixteen (16) playing pieces arranged on a playing board having 64 squares. Like shaped playing pieces have a capability to move in certain directions and a predetermined number of squares—all in a back and forth quest to eliminate the other player's playing pieces and, ultimately, to inescapably capture or "checkmate" the other's 'King.'

Although presumably stimulating, the game of chess can be improved by the non-obvious addition of both physical structures and methodology of using those structures in game play. The present invention is a method and apparatus concerning a board game that provides a stimulating, challenging, and rewarding experience for the players. The present invention is preferably called "Spectrum Chess" and is similar to a conventional chess game in that the winning player must capture all of the opposing player's playing pieces. However, this also presents an improvement over conventional chess games through the use of a dual point assignment scheme capable of varying the points assigned to the playing pieces. Additionally, a negative containment grid is a physical structure that can be used to hold certain playing pieces in reserve for emergency use when the opponent starts capturing too many pieces.

SUMMARY OF THE INVENTION

A game apparatus according to the present invention includes a housing defining an interior area for electronic components, a top wall of which includes a game board having squares for receiving respective game pieces. A plurality of input buttons are included on each end of the housing by which a player may enter points to be awarded to corresponding moves of game pieces, the point being incremented on respective digital displays. The game board includes a negative containment grid for receiving one or more auxiliary game pieces. Points may be scored as game pieces are moved and opposing game pieces are captured, the game pieces having predetermined high and low values. In addition, the method of use includes a dual point assignment scheme capable of varying the points assigned to the playing pieces.

Therefore, a general object of this invention is to provide an apparatus for playing a chess-like game that assigns points to the jumping or elimination of an opponent's game pieces.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
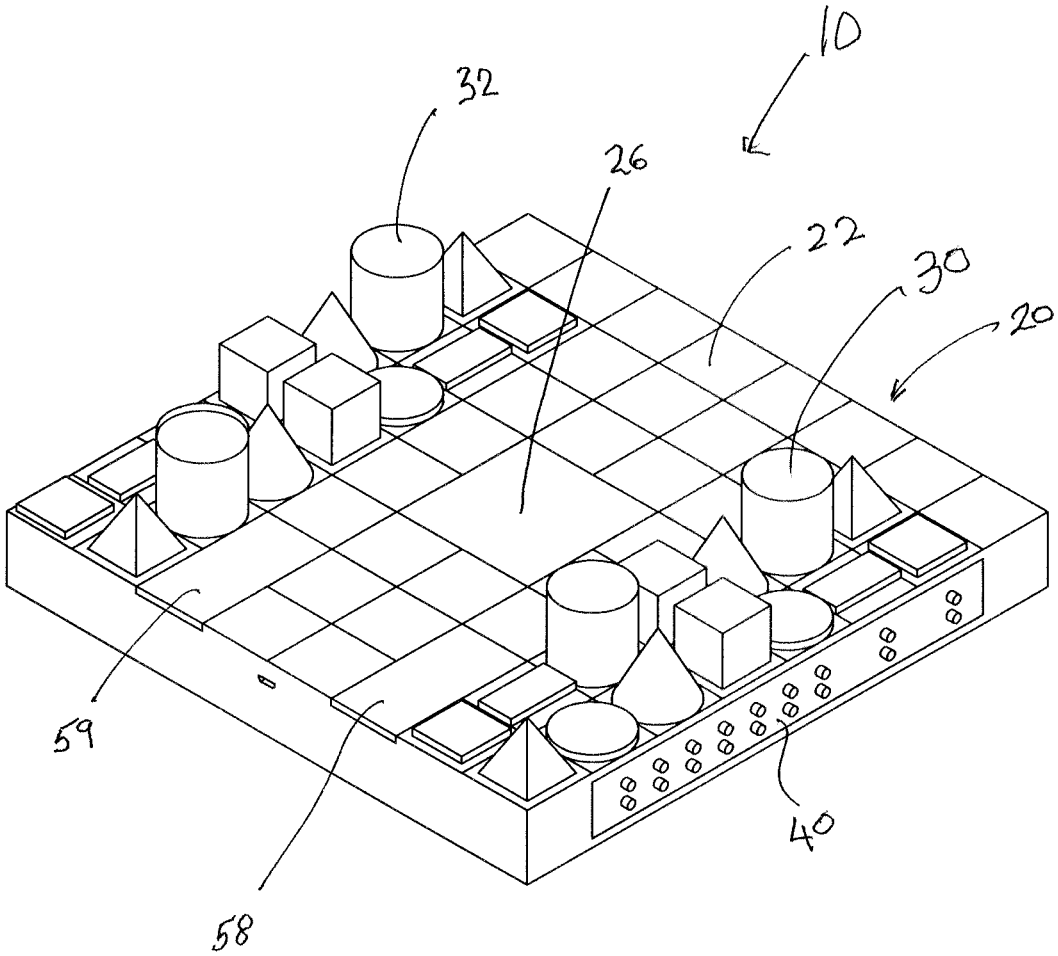
FIG. 1 is a perspective view of a game apparatus according to a preferred embodiment of the present invention.
Figure 2:
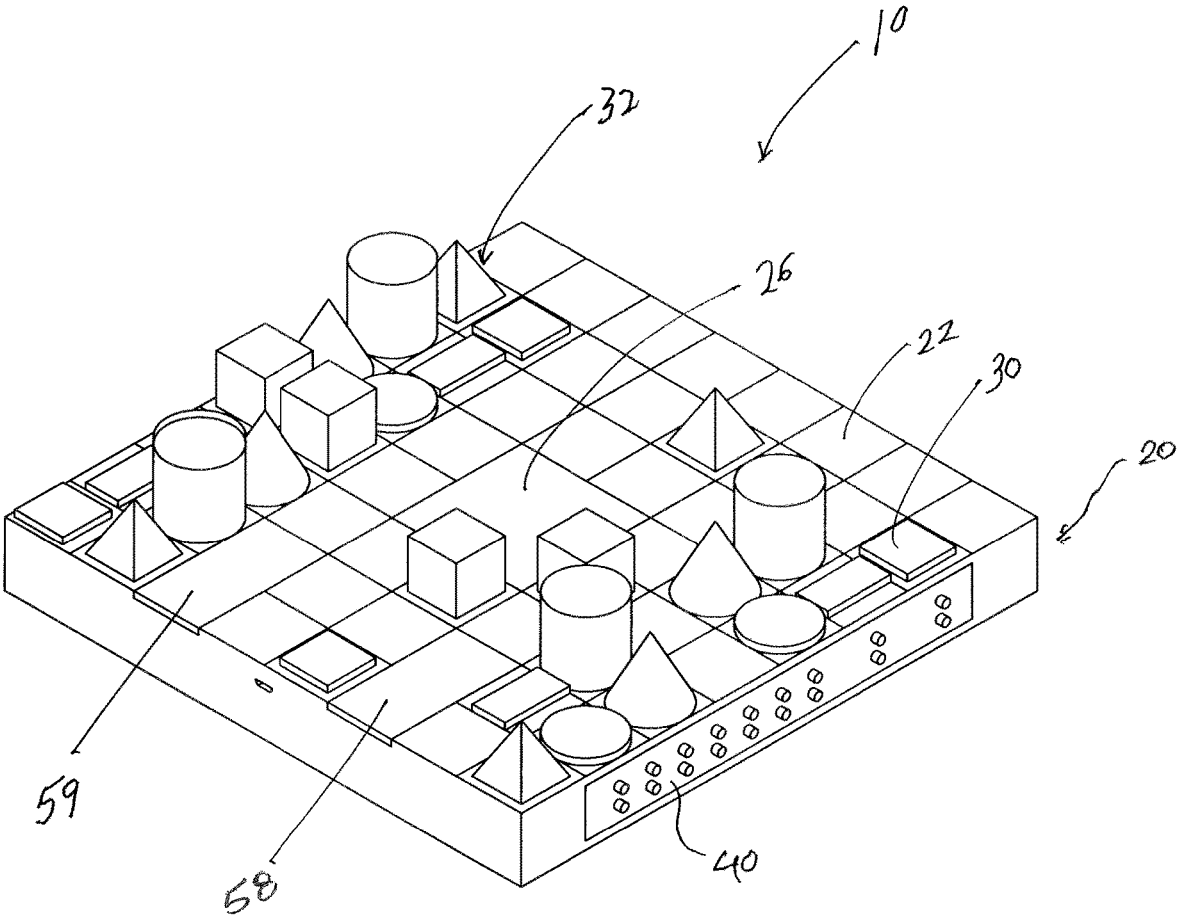
FIG. 2 is another perspective view of the game apparatus as in FIG. 1, illustrating the game in use.
Figure 3:
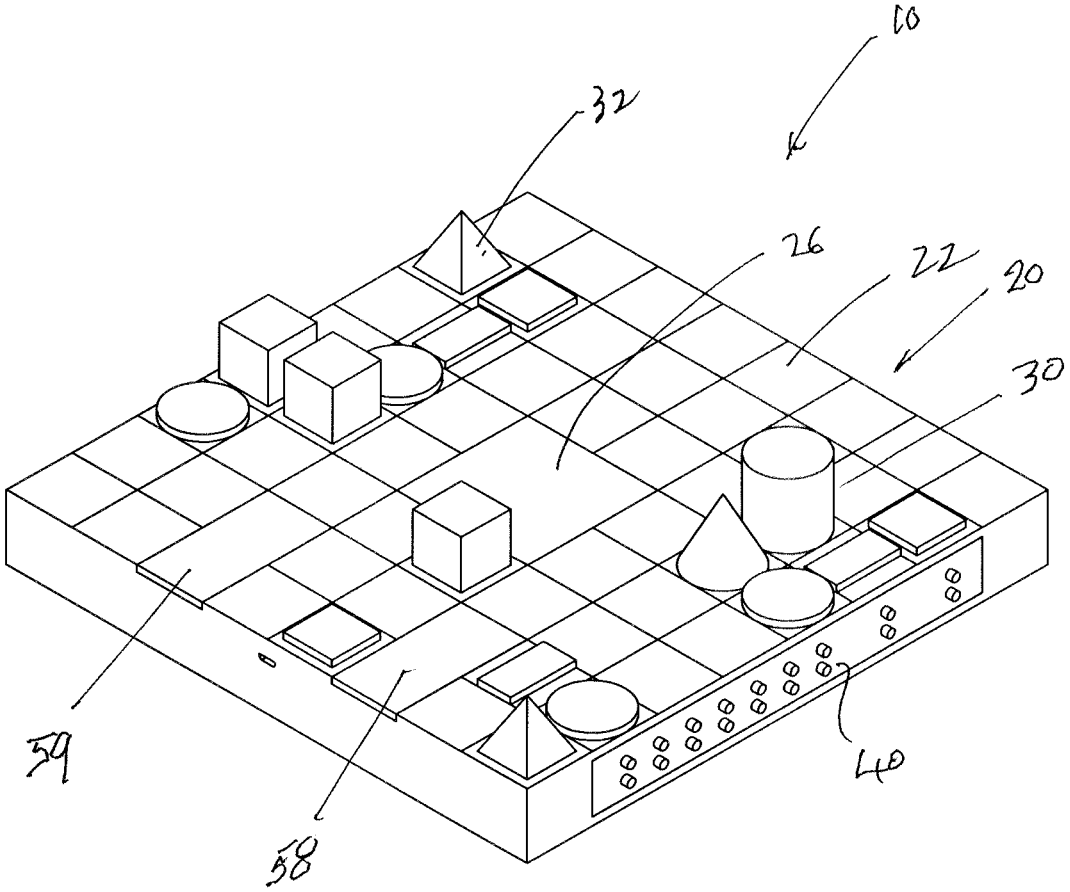
FIG. 3 is still another perspective view of the game apparatus as in FIG. 1, illustrating the game in use.
Figure 4:
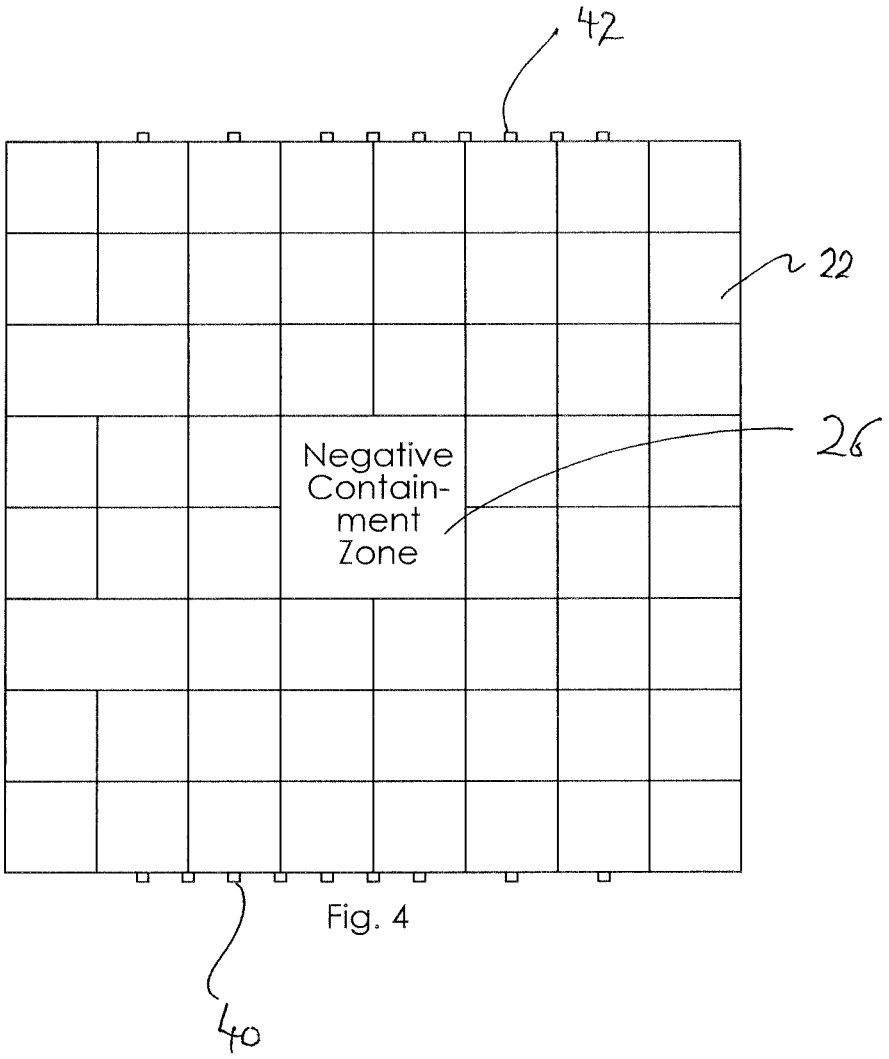
FIG. 4 is a top view of the game apparatus as in FIG. 1.
Figure 5A:
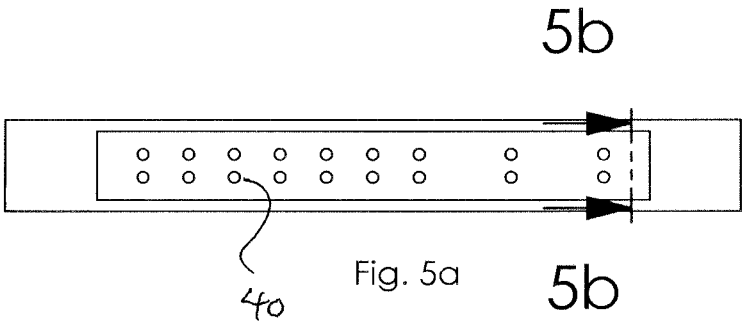
FIG. 5*a* is a side view of the game apparatus as in FIG. 4.
Figure 5B:
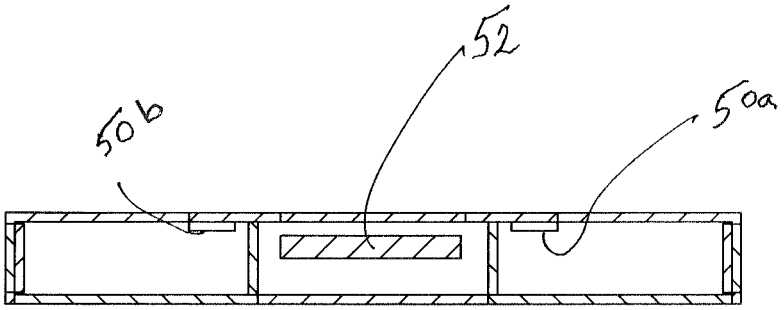
FIG. 5*b* is a sectional view taken along line 5*b*-5*b* of FIG. 5*a;*
Figure 6:
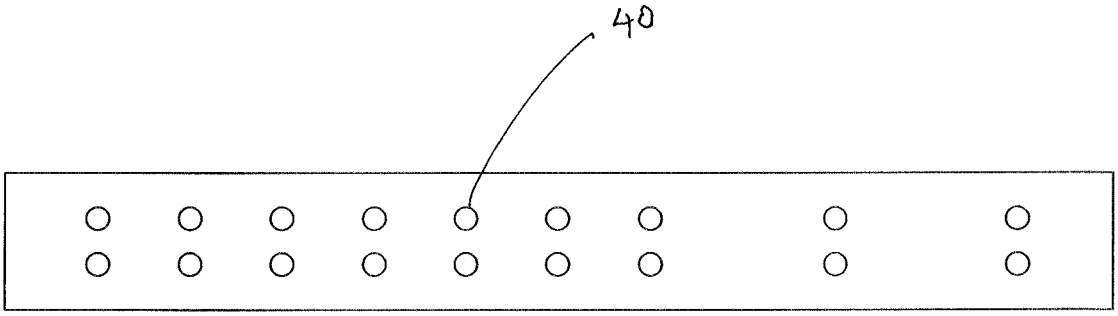
FIG. 6 is an enlarged view of the apparatus of FIG. 5*a;*
Figure 7:
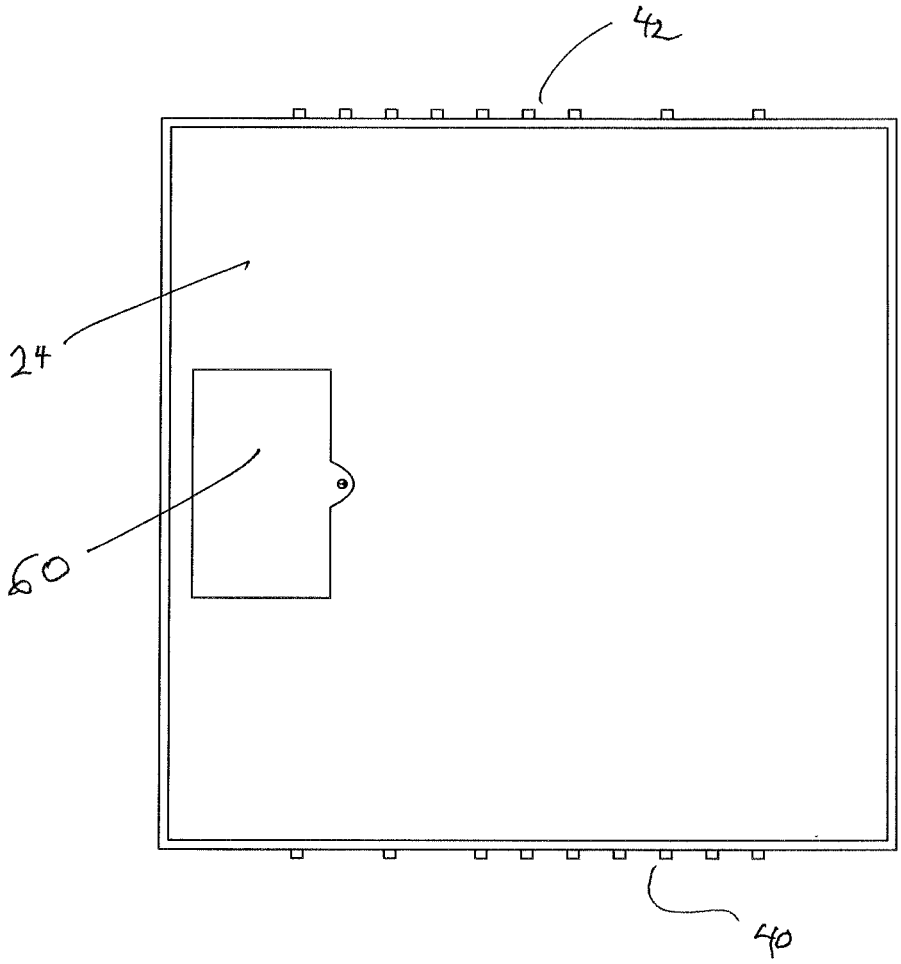
FIG. 7 is a bottom view of the apparatus as in FIG. 1.
Figure 8:
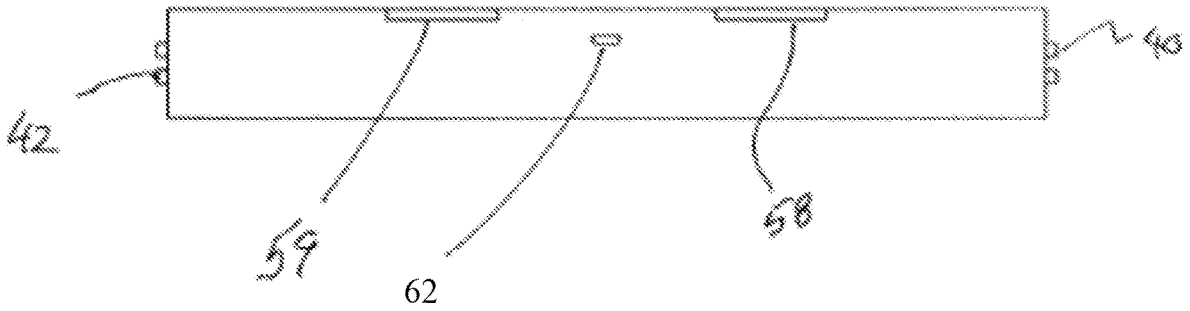
FIG. 8 is another side view of the game apparatus as in FIG. 4.
Figure 9:
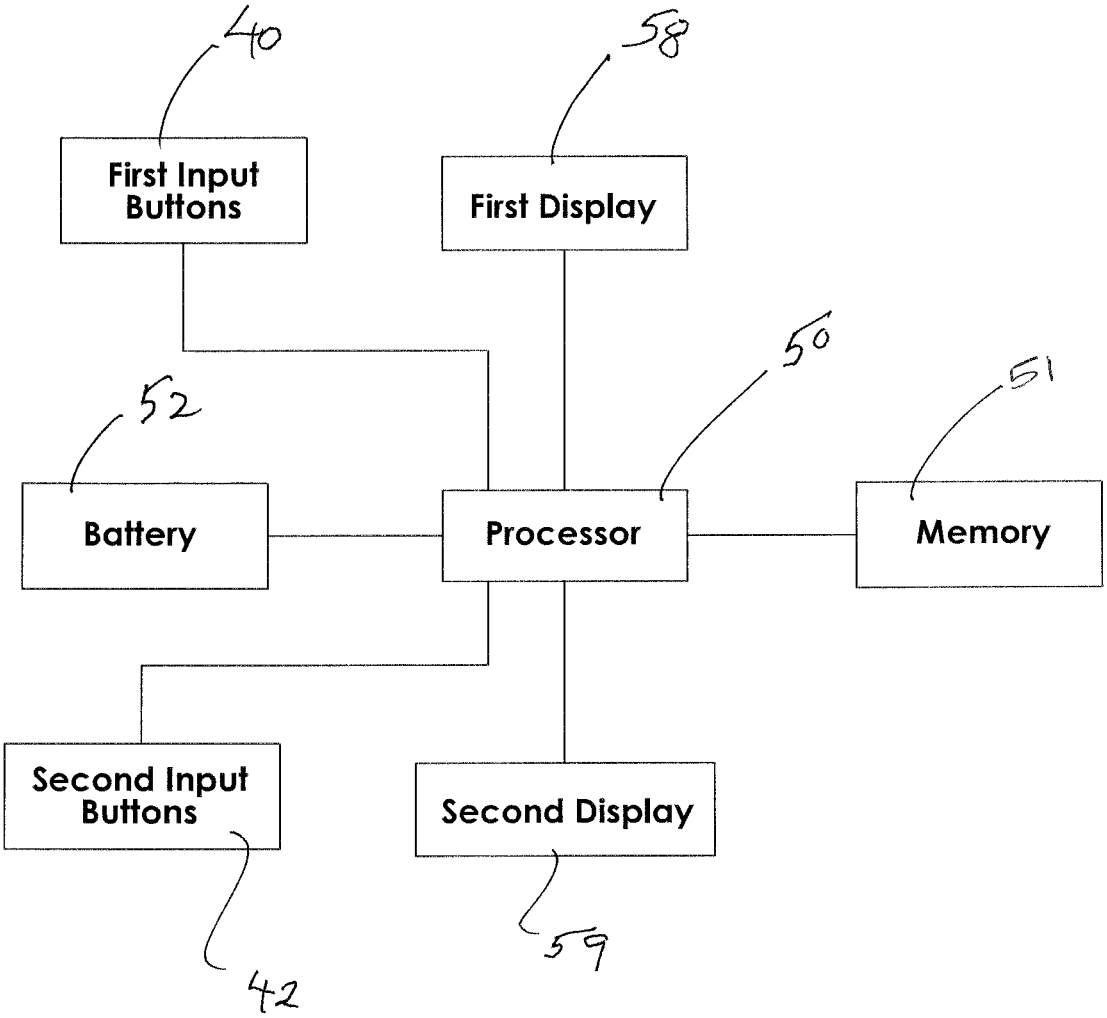
FIG. 9 is a block diagram illustrating the electronics according to a preferred embodiment of the game apparatus.

A method and apparatus for playing a chess-like game will now be described in detail with reference to FIGS. 1 to 9 of the accompanying drawings.

The game according to the present invention is embodied in a unique physical platform having electronic components. Specifically, the game apparatus 10 includes a housing 20 having a top wall 22, a bottom wall 24 opposite and parallel to the top wall 22 and having an identical dimension. The top and bottom walls are connected at respective peripheral edges by opposed and parallel front and rear walls and opposed side walls. The housing 20 defines an interior area in which various electronic components may be positioned.

The top wall 22 may include what is similar to a chess game board having indicia for receiving various game pieces—specifically, for receiving up to 14 game pieces for each of two players. More particularly, the game apparatus 10 includes a plurality of first game pieces 30 and a plurality of second game pieces 32. In an embodiment, the game pieces may be indicative of three-dimensional objects and each one may include both a shape indicia and color indicia. Each game piece may have a color indicia, a shape indicia, and be associated with a dual point assignment scheme as will be described later.

Now with reference to the electronic components, a battery 52 may be positioned in the interior area along with a processor 50 in data communication with the battery 52. In some embodiments, the processor 50 may actually include two processors, labeled 50*a* and 50*b*—one dedicated to each of two game players as will become apparent below. It is understood that the processor 50 may be in data communication with a non-volatile memory 51 storing programming instructions and data or may alternatively include equivalent circuitry or circuit boards. In addition, each processor may include a controller as an interface between input buttons, processor 50, and respective displays.

In another aspect, the invention includes a plurality of first input buttons 40 positioned on a front wall of the housing 20 and in data communication with the processor 50 (or a first processor). Similarly, the invention includes a second plurality of second input buttons 42 positioned on a rear wall of the housing 20 and in data communication with the processor 50 (or a second processor). In an embodiment, the plurality of first input buttons 40 includes a row of high value buttons spaced apart laterally from one another and a row of low value buttons also being spaced apart laterally. The high and low value buttons are related to a dual point assignment scheme used for game play as will be described later.

In another aspect, the apparatus 10 includes a first display 58, such as an LED display capable of displaying numerical indicia. The first display 58 may be in data communication with the processor 50 and first input buttons 40. Similarly, the apparatus 10 includes a second display 59, such as an LED display capable of displaying numerical indicia. The second display 59 may be in data communication with the processor 50 and second input buttons 42.

The processor 50 is operable—such as by executing programming instructions or via circuitry—to increment a numerical value stored in memory and displayed on the first display 58 or second display 59, respectively, when a respective input button is pressed. The rules for which button may be pressed on what circumstances will be described below relative to an exemplary embodiment. It is understood that some input buttons may be given specific functions; for instance, one of the input buttons may automatically cause the point total display on a corresponding display to be incremented by double or even quadruple a normal amount. Another may "clear" a display, and another may simply turn the game on or off.

In still another aspect, the game board may include what will be referred to as a "negative containment area 26." This area includes indicia indicative of receiving at least one but perhaps more game pieces associated with a player. The pieces positioned in the negative containment area are considered "reserve" pieces whose use and significance will be described later. Preferably, negative containment area is near the center of the game board, displaced from the initial position of the first or second plurality of game pieces.

In addition, a battery door 60 may be positioned on the bottom wall 24 and provide selective access to the battery 52 in the interior area. Further, the battery may be recharged or the processor 50 may receive data via a USB port 62 (or micro-USB).

Now, the following description is a description of an exemplary embodiment for using the structure of the game apparatus 10 described above.

The present invention concerns a method and apparatus providing a unique board game comprising multi-colored playing pieces (as described above) valued according to a dual point assignment scheme (described below). The preferred embodiment of the present invention utilizes a set of multi-colored playing pieces fashioned into a square, a rectangle, a circle, a cube, a cone, a cylinder, and a pyramid colored red, orange, yellow, green, blue, and violet respectively.

It is to be understood that the specific shapes and colors of individual playing pieces are non-limiting and may change in alternate embodiments without departing from the spirit or scope of the present invention.

Each playing piece can have two scores based on the dual point assignment scheme. The specific point values of the playing pieces are arbitrary and serve only to keep track of which player is winning. The specific point value given to the playing pieces may thus change in accordance to one or more embodiments of the present invention. The dual point assignment scheme assigns a high and low score to each playing piece. For instance, the "square" playing piece may have a high value of 740 and a low value of 625. The "cube" playing piece may have a high value of 565 and a low value of 520, and so on.

In reference to the figures, the present board game is played on a board having 64 grid places allowing freedom of movement for the playing pieces. Playing pieces move about the board by hopping from one grid place to another and must always be confined within at least one grid place when not in play. At least two players are accommodated by the present board game. Each player is given two sets of playing pieces for a total of 14 playing pieces. Opposing players place their playing pieces on at least two starting grids disposed on the upper and bottom portion of the board. A spectrum bar is a sensory device which transmits the total point read out when a playing piece is captured (i.e. the displays). Conventional electronic components such as a liquid crystal display (LCD) display, a microcontroller, and a printed circuit board (PCB) may be utilized to enable digital point read out function. A negative containment grid 26 is located centrically on the board and acts as a storage area where the players may choose to place any of the playing pieces.

The rules for movement and capture of playing pieces are disclosed herein. The present game, preferably called spectrum chess, is designed to be played by two people. Like chess the players must clear the opposing player's board but—unlike chess—a point system is incorporated in the game. Playing pieces are afforded freedom of movement in the forward and backward direction. In order to capture a piece, a player may simply move forward with a playing piece and capture an opposing player's playing piece. All playing pieces are free to move forward as an offensive move or backward as a defensive ploy if it is a higher scored playing piece. Each player must choose one playing piece to dispose into the negative containment area of the board. The playing piece may be either high or low valued playing piece depending on the discretion of the players.

Playing pieces disposed in the negative containment grid 26 acts as reserves which the player can draw upon when in danger of running out of playing pieces. Hereinafter, these playing piece disposed in the negative containment area will be called the reserve playing piece. If a reserve playing piece is captured by an opponent when in play, double the points are awarded to the capturing player. For example, if a playing piece such as a high valued square, which is valued at 740 points, is captured while utilized as a reserve playing piece, the present board game allows for an additional 740 points to be awarded, for a total of 1,480 points. This double rule only applies to any playing piece placed on the negative containment grid.

For most of the game, the reserve playing pieces must be kept in the negative containment grid 26. They are only allowed to come into play if five of the 14 playing pieces owned by a player is captured by the opposing player. The reserve playing pieces are also afforded with greater flexibility of movement. They are allowed to strategically move in any direction on the board such as backward, forward, and sideways. When utilized for their intended purpose, the reserve playing pieces help prolong the board game by making the playing field even and preventing an opposing player from achieving a quick victory. Likewise, if the negative containment grid playing piece captures an opponent's playing piece, the player may be awarded four times the value of the playing piece. This movement is only allowed once.

It is understood that while certain forms of this invention have been illustrated and described, it is not limited thereto except insofar as such limitations are included in the following claims and allowable functional equivalents thereof.

The invention claimed is:

1. A game apparatus, comprising:

a housing having a top wall and a bottom wall parallel to said top wall, said housing having a front wall, a rear wall, and a pair of side walls extending between said top and bottom walls, respectively, so as to define an interior area, said top wall not divided by any display that is perpendicular to said top wall;

a battery and a processor in data communication with said battery, said battery and said microcontroller situated in said interior area;

a plurality of first input buttons positioned on said front wall and in data communication with said microcontroller;

a plurality of second input buttons positioned on said rear wall and in data communication with said processor;

a plurality of first game pieces each having a first indicia;

a plurality of second game pieces each having a second indicia, said second indicia being different from said first indicia;

wherein said top wall includes a game board having indicia indicative of a game board, said game board having 64 grid places;

wherein said plurality of first game pieces are initially positioned on said game board opposite said plurality of second game pieces;

a first display in communication with said processor for displaying numeric indicia when energized, said first display comprised by said top wall, said first display not perpendicular to said top wall, said first display on a first 2 grid places of said 64 grid places of said game board;

a second display in communication with said processor for displaying numeric indicia when energized, said second display comprised by said top wall, said second display not perpendicular to said top wall, said second display on a second 2 grid places of said 64 grid places of said game board;

wherein said processor is in data communication with said plurality of first input buttons and with said plurality of second input buttons and is operable to increment said first display and said second display, respectively, according to detecting a push of one of said plurality of first input buttons and said plurality of second input buttons, respectively.

2. The game apparatus as in claim 1, wherein:

said game includes a negative containment area for receiving more than one game piece of said plurality of first game pieces and for receiving more than one game piece of said plurality of said second game pieces, said negative containment area located at 4 grid places at a center of the 64 grid places of said game board;

said negative containment area is displaced from an initial positioning of said plurality of first game pieces and from an initial positioning of said plurality of second game pieces.

3. The game apparatus as in claim 1, wherein:

said plurality of first input buttons includes a row of high value buttons spaced apart laterally from one another and a row of low value buttons spaced apart from one another;

said plurality of second input buttons includes a row of high value buttons spaced apart laterally from one another and a row of low value buttons spaced apart from one another.

4. The game apparatus as in claim 3, wherein said processor includes:

a first processor in communication with said plurality of first input buttons and with said first display;

a second processor in communication with said plurality of second input buttons and with said second display.

5. The game apparatus as in claim 3, wherein each first game piece is associated with a dual point assignment scheme in which said each first game piece is associated with both a high score and a low score;

each second game piece is associated with a dual point assignment scheme in which said each second game piece is associated with both a high score and a low score.

6. The game apparatus as in claim 5, wherein:

one input button of said plurality of first input buttons is in data communication with said processor and operable to cause an increment of double a point value associated with a game piece of said plurality of first game pieces, respectively;

one input button of said plurality of second input buttons is in data communication with said processor and operable to cause an increment of double a point value associated with a game piece of said plurality of second game pieces, respectively.

7. A method comprising:

causing a game to be played on a game apparatus, game points of said game determined via a dual point assignment scheme, said dual point assignment scheme comprising an assignment of a high score and a low score to each of a plurality of playing pieces, said game apparatus comprising:

a top wall, said top wall not divided by any display that is perpendicular to said top wall, wherein said top wall includes a game board having 64 grid places;

a first display and a second display comprised by said top wall of said game apparatus, wherein game points of a first player are displayed on said first display and game points of a second player are displayed on said second display, said first display on a first 2 grid places of the 64 grid places of said game board, said second display on a second 2 grid places of the 64 grid places of said game board;

an interior area, said interior area comprising a processor positioned therein, said processor coupled to said first display and said second display, said processor causing display of game points on said first display and said second display;

a plurality of first input buttons operated by said first player, said plurality of first input buttons on a first side of said game apparatus, said plurality of first input buttons comprising a row of high value buttons and a row of low value buttons, said game points based upon a selection by said first player of a set of said plurality of first input buttons;

a plurality of second input buttons operated by said second player, said plurality of second input buttons on a second side of said game apparatus, said second input buttons comprising a row of high value buttons and a row of low value buttons, said game points based upon a selection by said second player of a set of said plurality of second input buttons; and a negative containment area constructed to receive reserve game pieces said negative containment area located at 4 grid places at a center of the 64 grid places of said game board wherein causing the game to be played comprises:

selecting, by said first player, said set of said plurality of first input buttons, displaying, in said first display, said game points based upon said set of first input buttons selected by said first player;

selecting, by said second player, said set of said plurality of second input buttons; and displaying, in said second display, said game points based upon said set of second input buttons selected by said second player.

* * * * *